US008317150B2

(12) United States Patent
Baechle

(10) Patent No.: US 8,317,150 B2
(45) Date of Patent: Nov. 27, 2012

(54) TRUNCATED PYRAMID SHAPED SHIPPING BASE

(75) Inventor: James R Baechle, Gallatin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/285,141

(22) Filed: Oct. 31, 2011

(65) Prior Publication Data

US 2012/0043445 A1 Feb. 23, 2012

Related U.S. Application Data

(62) Division of application No. 12/759,910, filed on Apr. 14, 2010, now Pat. No. 8,074,952.

(51) Int. Cl.
*A47B 91/00* (2006.01)

(52) U.S. Cl. ..... 248/346.01; 248/678; 108/53.1; 108/55.3; 229/113

(58) Field of Classification Search ..... 248/346.03, 248/678; 206/320, 586; 108/51.3, 51.1, 108/55.3, 57.29; 229/113, 116
See application file for complete search history.

(56) References Cited

U.S. PATENT DOCUMENTS 2,544,075 A 3/1951 Ernst et al.
3,661,318 A * 5/1972 Miller et al. ..... 206/320
4,196,807 A * 4/1980 Brom ..... 206/427
4,266,716 A 5/1981 Austin
4,366,902 A * 1/1983 Fanson et al. ..... 206/320
4,624,117 A * 11/1986 Ory et al. ..... 68/3 R
5,016,853 A * 5/1991 Cox ..... 248/523
5,058,803 A * 10/1991 Gulliver ..... 229/148
5,083,845 A * 1/1992 Sparks et al. ..... 312/228
5,226,543 A * 7/1993 Foos et al. ..... 206/592
5,385,232 A * 1/1995 Foos et al. ..... 206/320
5,624,024 A * 4/1997 Miess ..... 206/172
5,706,951 A * 1/1998 Oinuma et al. ..... 206/710
5,803,264 A * 9/1998 Gersten et al. ..... 206/549
5,806,286 A * 9/1998 Oinuma et al. ..... 53/472
6,298,989 B1 * 10/2001 Chu ..... 206/320
7,014,160 B2 * 3/2006 Muyskens ..... 248/346.03
2005/0269476 A1 * 12/2005 Muyskens ..... 248/346.03
2008/0173781 A1 * 7/2008 Muyskens ..... 248/346.01

* cited by examiner

*Primary Examiner* — Terrell McKinnon
*Assistant Examiner* — Daniel J Breslin
(74) *Attorney, Agent, or Firm* — Miller, Matthias & Hull LLP

(57) ABSTRACT

A shipping base shaped like a square, truncated pyramid for use with a washing machine of the type having an undercarriage suspended below the wash tub. The shipping base has an opening in the top of the truncated pyramid into which the washing machine undercarriage is lowered until the undercarriage is suspended within the space defined by base, and an integrally formed frame-like pallet for supporting the washing machine. The opening is only slightly larger than the dimensions of the undercarriage so that the shipping base prevents any significant lateral movement of the undercarriage or the washing machine tub.

2 Claims, 5 Drawing Sheets

TRUNCATED PYRAMID SHAPED SHIPPING BASE

CROSS REFERENCE TO RELATED APPLICATION

This application is a divisional of U.S. patent application Ser. No. 12/759,910, filed Apr. 14, 2010.

BACKGROUND

1. Field of the Invention

This invention relates to a shipping base for a large appliance. More particularly, this invention relates to a truncated pyramid shaped shipping base for a washing machine in which the base surrounds the washing machine motor to restrain the movement of the motor and washing machine tub during handling and shipping.

2. Description of the Related Art

In many modern top-loading washing machines the interior wash tub is suspended from the cabinet by suspension rods with the motor mounted to the underside of the tub.

The clearance between the wash tub and the appliance cabinet is often no more than about an inch (2.54 cm), and so the cabinet is susceptible to damage from impacts from the wash tub when the appliance is moved during shipping. In addition, the motor may be susceptible to damage caused by movement of the motor and tub relative to the cabinet during handling and shipping.

Thus it is an object of the present invention to provide a shipping base that restricts the movement of the tub and motor during shipping and handling.

Another object of the invention is to provide a three-dimensional shipping base that is nestable in order to reduce stacking height.

Further and additional objects will appear from the description, accompanying drawings, and appended claims.

BRIEF SUMMARY OF THE INVENTION

The present invention is a shipping base that not only supports the washing machine but also surrounds the washing machine motor and motor housing to prevent or limit movement of the motor and wash tub with respect to the cabinet during handling and shipping. In one embodiment the shipping base is made from injection molded plastic or foam material such as expanded polystyrene foam (EPS), and has a truncated pyramid shape. The sides of the pyramid are formed by opposing, slanted left and right side panels and opposing, slanted front and rear end panels. A top panel extends horizontally inward from the top edges of the side and end panels. The top panel and, preferably, one of the end panels define a top opening configured to receive the washing machine mechanical undercarriage, primarily the motor and motor housing. The top opening should be only slightly larger than the dimensions of the washing machine motor and any mechanical components to which it is attached so as to limit any lateral movement of the motor and, by extension, the washing machine tub during shipping and handling.

In a second embodiment the shipping base comprises nested inner and outer shells made of paper and foam cushioning blocks affixed to the corners of the outer shell. The inner shell and outer shell are each formed from a unitary (one piece) blank, preferably made of corrugated board that is folded into a three-dimensional, truncated pyramid shape. Aligned openings in at the top of the inner and outer shells are configured to receive the washing machine motor and motor housing so that the undercarriage sits inside the pyramid shaped base. The foam cushioning blocks are glued to flanges extending horizontally from the bottom of the pyramid shaped portion of the shipping base.

The washing machine is mounted to the shipping base with the washing machine feet inserted into corner openings. The washing machine motor is inserted within the top opening of the base until the motor is suspended within the space defined by the shipping base. The top opening should be only slightly larger than the dimensions of the motor so that the shipping base prevents any significant movement of the motor and any mechanical components attached to the motor or the underside of the washing machine tub.

DETAILED DESCRIPTION OF THE INVENTION

Figure 1:
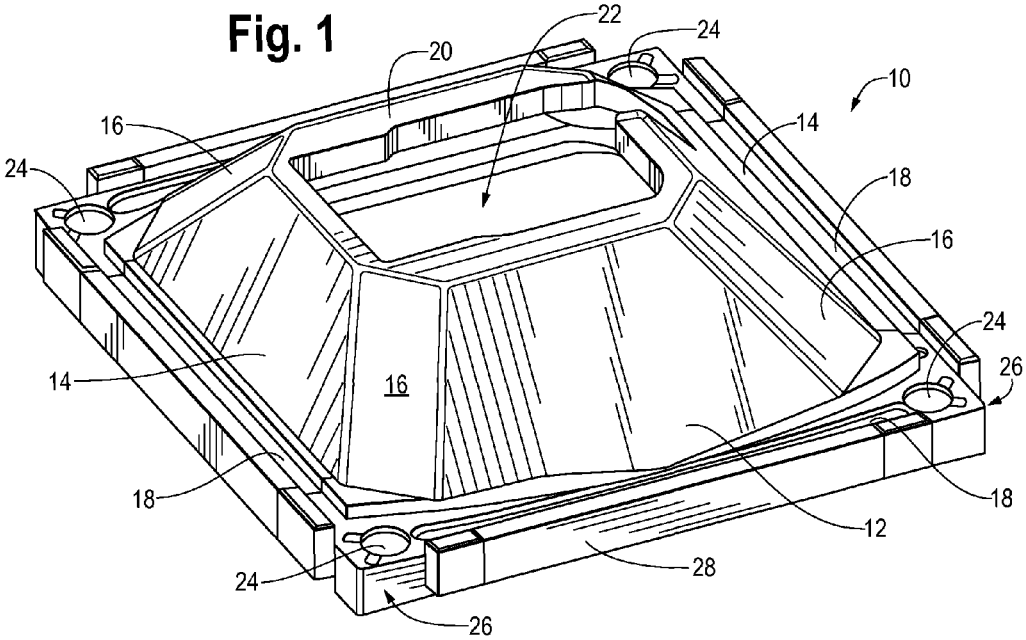
FIG. 1 is a perspective view of a first embodiment of a truncated pyramid shaped shipping base according to the present invention.
Figure 2:
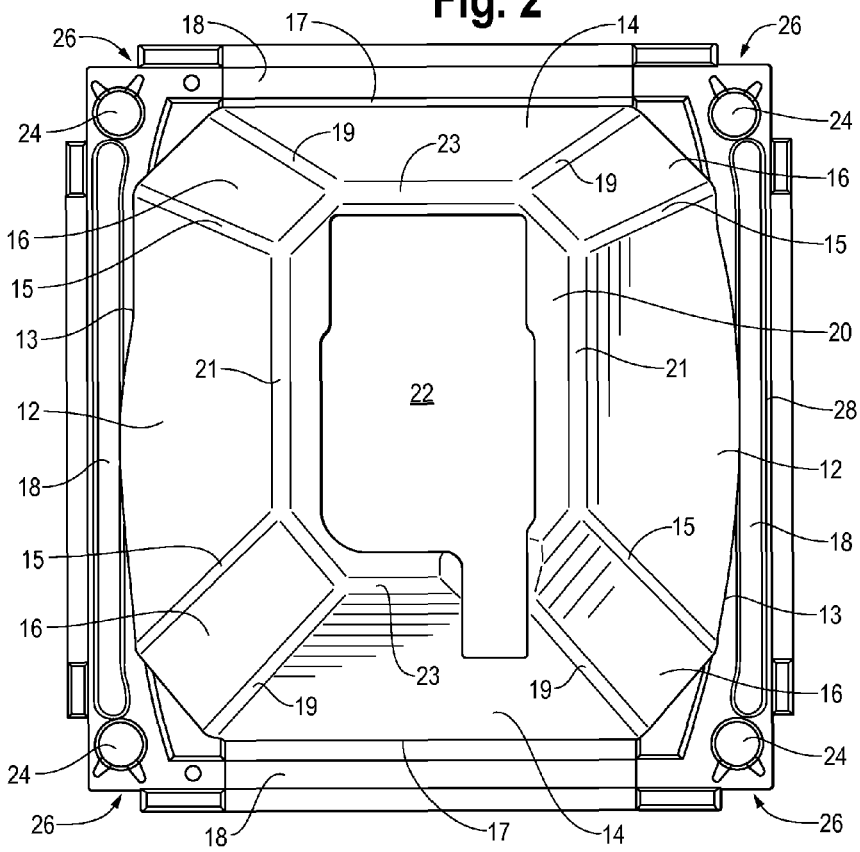
FIG. 2 is a top plan view of the shipping base of FIG. 1.
Figure 3:
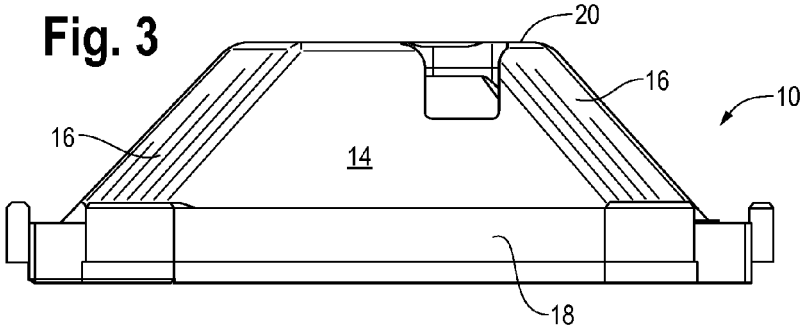
FIG. 3 is a front elevational view of the shipping base of FIG. 1.
Figure 4:
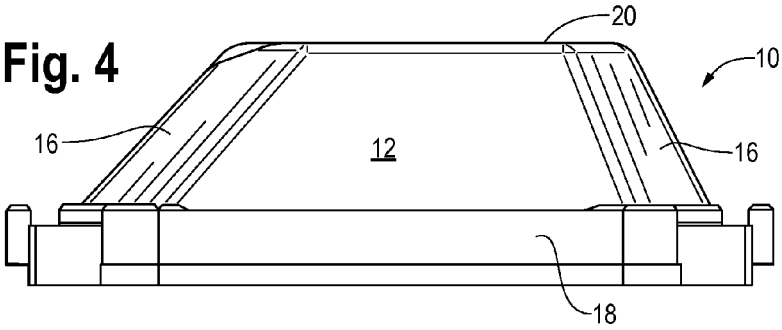
FIG. 4 is a right side elevational view of the shipping base of FIG. 1.
Figure 5:
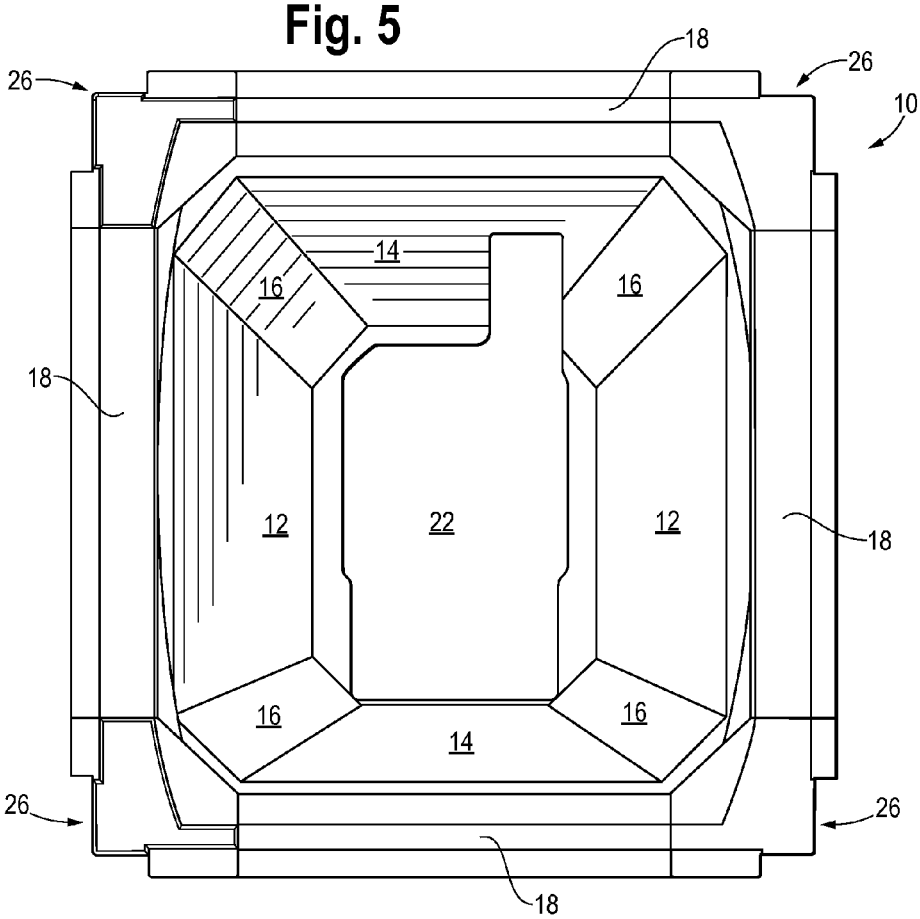
FIG. 5 is a bottom plan view of the shipping base of FIG. 1.
Figure 6:
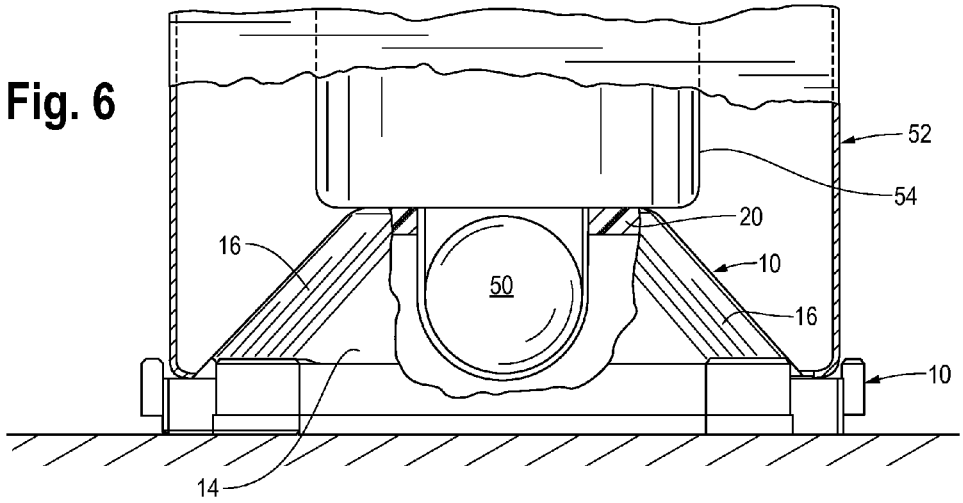
FIG. 6 is a view of the shipping base of FIG. 1 shown installed under a washing machine, the washing machine cabinet shown in cutaway view.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Many modern top-loading washing machines have a metal outer cabinet and a plastic wash tub suspended within the cabinet by suspension rods or the like. A metal plate is affixed to the underside of the wash tub and a motor and other mechanical components (such as a transmission) are mounted to the underside of the plate. A bracket may be mounted to the plate to surround and protect the motor and other components. The washing machine cabinet does not have a bottom panel, which allows for easy access to the space within the cabinet under the tub.

The clearance between the wash tub and the appliance cabinet is often no more than about an inch (2.54 cm), and so the cabinet is susceptible to damage from impacts from the wash tub when the appliance is moved during shipping. The present invention is intended solve this problem by providing a shipping base that surrounds the undercarriage and prevents or limits movement of the undercarriage and tub during handling and shipping.

The Shipping Base

First (Plastic) Embodiment

Turning to the drawings, there is shown in FIGS. 1-7 one embodiment of the present invention, a truncated (flat topped) pyramid shaped shipping base 10 for use with a washing machine. The shipping base 10 may be made either from injection molded plastic or from a single piece of foam material, preferably expanded polystyrene foam (EPS). The base 10 comprises opposing, slanted left and right side panels 12 and opposing, slanted front and rear end panels 14. Each side panel 12 is shaped substantially like a truncated isosceles triangle having a bottom edge 13 and first upwardly converging vertical edges 15. Similarly, each end panel 14 is shaped substantially like a truncated isosceles triangle having a bottom edge 17 and second upwardly converging vertical edges 19. The side panels 12 and the end panels 14 extend upwardly and are joined together to form the major lateral faces of a square truncated pyramid having four corner panels 16. Preferably the four corner panels 16 of the truncated pyramid where the side and end panels 12, 14 meet are beveled, as shown in the figures.

A top panel 20 extends horizontally inward from the top edges 21, 23 of the side and end panels 12, 14. The top panel 20 and, preferably, one of the end panels 14, define a top opening 22 configured to receive the washing machine mechanical undercarriage 50, primarily the motor and motor housing. The top opening 22 should be only slightly larger than the dimensions of the washing machine motor 50 and any mechanical components to which it is attached so as to limit any lateral movement of the motor 50 and, by extension, the washing machine tub 54 during shipping and handling.

The side panels 12, end panels 14, corner panels 16 and top panel 20 define an interior space within the base 10 within which the undercarriage 50 can be suspended. As explained below, this interior space is used to protect and secure the undercarriage 50 of the washing machine 52. The top opening 22 may extend into one or both end panels as shown in the figures to further accommodate mechanical components that extend laterally beyond the interior space defined by the shipping base 10.

Flanges 18 extend horizontally outward from the bottom edges 13, 17 of the side panels 12 and end panels 14. Together the four flanges 18 create a substantially rectangular frame-like pallet 28 having four corners. The frame-like pallet 28 may be contoured to accommodate the lower cabinet contours of various washing machines. Openings 24 located at each corner of the frame-like pallet 28 are configured to receive appliance feet. The frame-like pallet 28 defines L-shaped spaces 26 at each corner of the base 10 to accommodate vertical corner posts (not shown).

Figure 7:
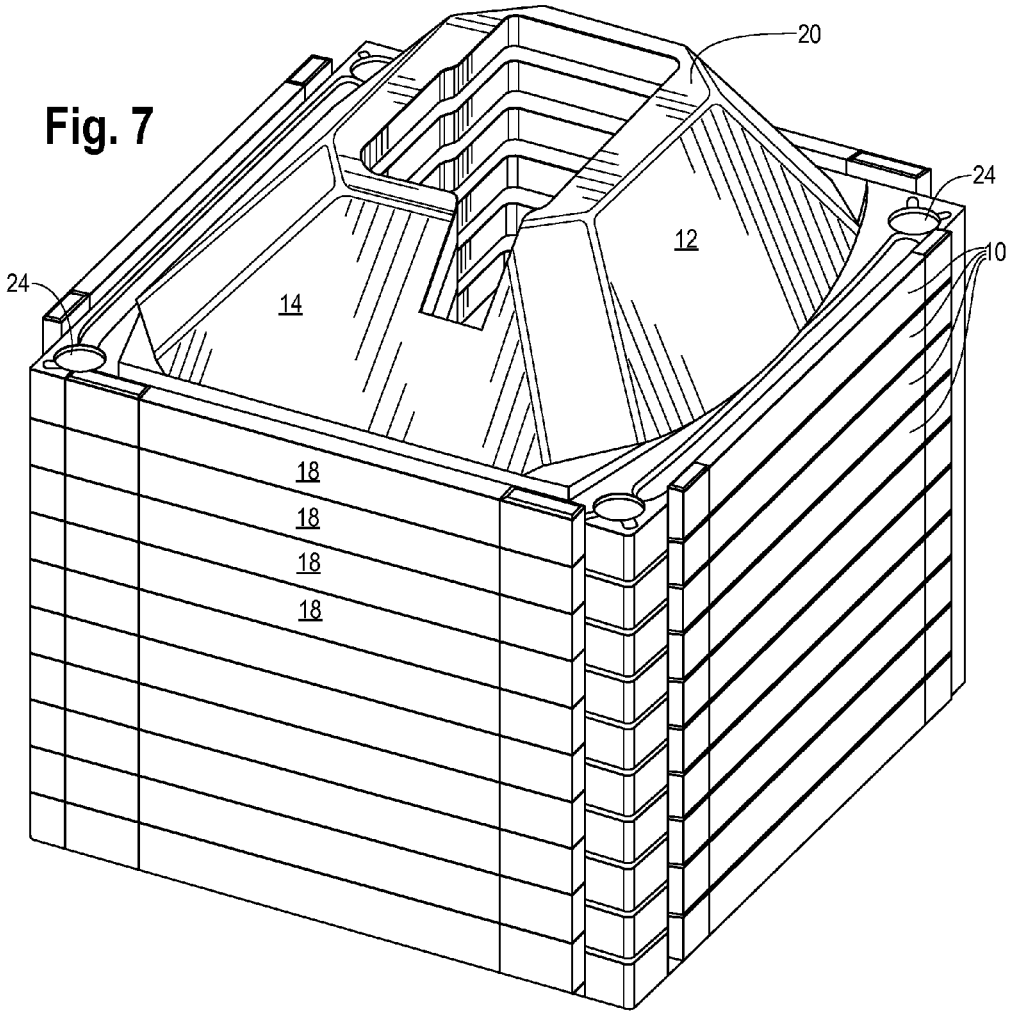
FIG. 7 is a perspective view of multiple shipping bases according to FIG. 5 shown in a stack.

As shown in FIG. 7, since the shipping bases 10 are substantially bottomless, multiple foam shipping bases 10 can be stacked with each base 10 (except the bottommost base 10) fitting in close proximity over another base 10 to minimize storage space. Alternatively, the frame-like pallet 28 can be replaced with a continuous flat pallet that extends under the truncated pyramid structure to add strength to the overall structure, but this would require more material and prevent nesting of the shipping bases.

Using the Shipping Base

To use the shipping base 10, the washing machine 52 is placed onto the shipping base 10 so that the washing machine feet fit within the openings 24 in the corners of the base 10. When placing the washing machine 52 onto the base 10, the undercarriage or motor 50 is lowered through the opening 22 in the top panel 20 until the motor 52 is suspended within the interior space of the shipping base 10.

Second (Composite) Embodiment

In a second embodiment of the invention shown in FIGS. 8-11, the shipping base is a composite shipping base 60, i.e., one made from multiple materials, again shaped like a truncated pyramid that surrounds the washing machine undercarriage and prevents or limits movement of the motor and tub during handling and shipping. The composite shipping base 60 comprises an outer shell 62 overlaying and adhered to an inner reinforcing member 64, and load bearing cushioning blocks 66 located at the corners.

Figure 10:
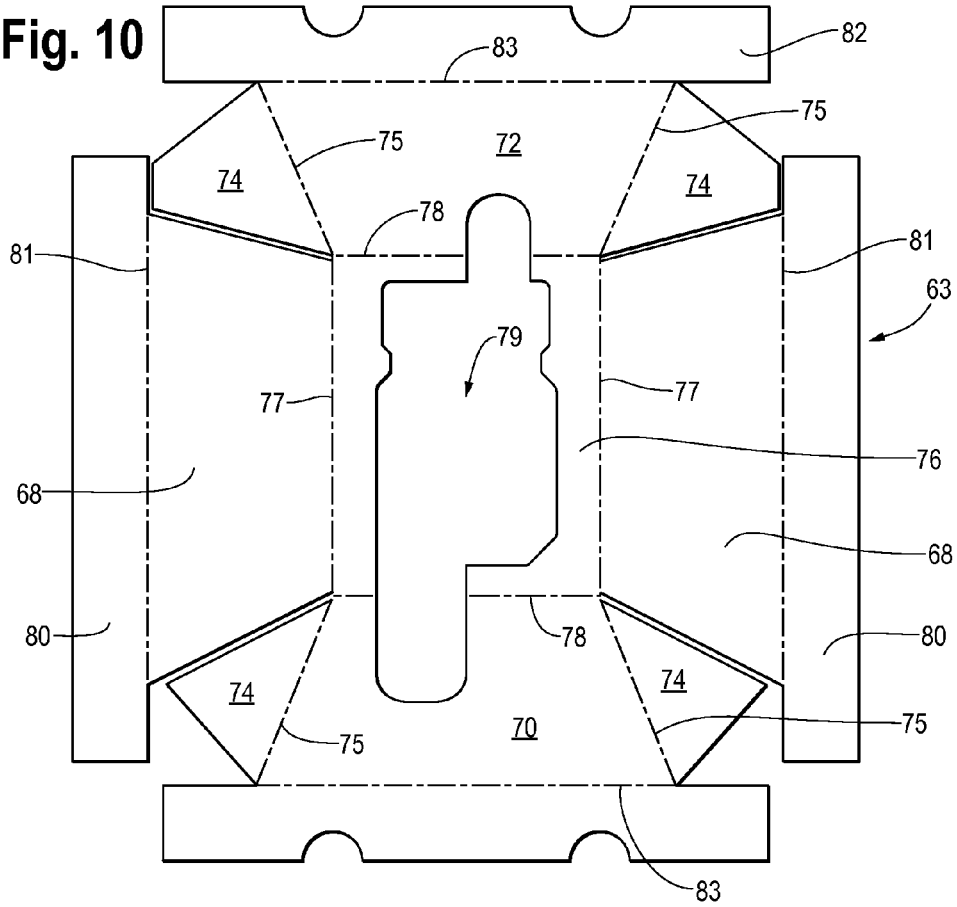
FIG. 10 is a top plan view of a blank for making the outer shell of the shipping base of FIG. 1.

Referring to FIG. 10, the outer shell 62 is made from a unitary (one piece) blank 63, preferably made of corrugated board that can be folded into a three-dimensional, truncated pyramid shape. The blank 63 comprises two side panels 68 of equal or similar dimensions, each side panel having a top edge 77 and a bottom edge 81; and opposing front and rear panels 70, 72, each having a top edge 78 and a bottom edge 83. Glue flaps 74 are hingedly attached to the front and rear panels 70, 72 along vertical fold lines 75. The side panels 68 are hingedly connected to a top panel 76 along two opposing upper fold lines 77. Likewise, the front and rear panels 70, 72 are hingedly connected to a top panel 76 along two opposing upper fold lines 78.

Preferably each side panel 68 and each front and rear panel 70, 72 is shaped substantially like a truncated isosceles triangle having a bottom edge 81, 83 and upwardly converging vertical edges. The side panels 68 and the front and rear panels 70, 72 extend upwardly and are joined together by the glue flaps 74 to form the major lateral faces of a square truncated pyramid having four vertical edges 75.

The top panel 76 defines a top opening 79 configured to receive a washing machine motor 50 so that the motor 50 sits inside the shipping base 60. The opening 79 may extend into the front and rear panels 70, 72 or into the side panels 68 to further accommodate mechanical components that extend laterally beyond the interior space defined by the shipping base 60.

Side flanges 80 are hingedly attached to the outer edge of each side panel 68 along lower fold lines 81. Front and rear flanges 82 are hingedly attached to the outer edge of the front and rear panels 70, 72 respectively along lower fold lines 83. The flanges 80, 82 extend horizontally outward from the bottom edge 81 of each side panel 68 and the bottom edge 83 of each front and rear panel 70, 72 to form a substantially rectangular, frame-like pallet having four corners.

Figure 11:
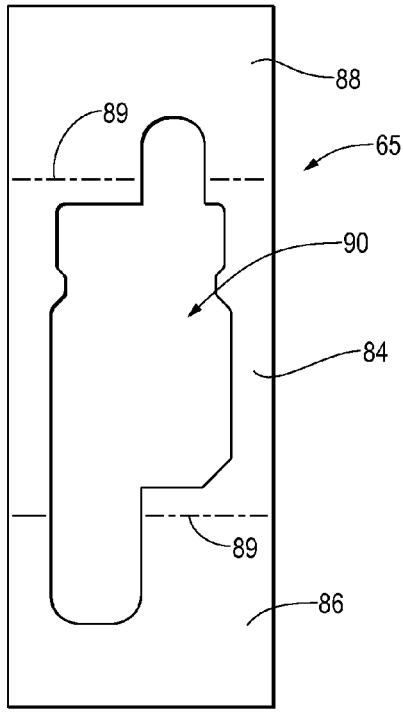
FIG. 11 is a top plan view of a blank for making the inner shell of the shipping base of FIG. 1.

Referring to FIG. 11, the inner reinforcing panel 64 is formed from a unitary (one piece) blank 65, comprising a rectangular top panel 84 and front and rear reinforcing panels 86, 88 hingedly attached to the top panel 84 along upper fold lines 89. The top panel 84 defines an opening 90. Like the opening 79 in the outer shell 62, the opening 90 may extend into the front and rear panels 86, 88 and is configured to receive the washing machine motor 50 so that the motor 50 and motor mount fit within the shipping base 60. The opening 90 in the inner reinforcing member 64 should be substantially the same shape as the opening 79 in the outer shell 62.

The cushioning blocks 66 preferably are made from resilient foam material such as expanded polystyrene. Each block 66 can have various configurations. In the configuration shown in FIG. 8, each block 66 is substantially rectangular and has a thickness of about one to two inches. An opening 92 disposed in the upper surface of each block 66 to accommodate an appliance foot. The cushioning blocks 66 have cutouts 93 to accommodate L-shaped vertical corner posts (not shown). The cushioning blocks 66 are glued or otherwise adhered to the frame-like pallet formed by the flanges 80, 82 so that the four openings 92 are located at the four corners of the shipping base 60 and align with the appliance feet.

Assembling the Composite Shipping Base

The composite shipping base 60 may be assembled as follows. First, the outer shell 62 is constructed by folding the blank 63 along fold lines 75, 77 and 78 to form a truncated pyramid structure with the glue flaps 74 overlapping the side panels 68. The glue flaps are then glued to the side panels 68. Next, the flanges 80, 82 are folded outward along fold lines 81, 83 until they all lie in the same horizontal plane. The flanges 80, 82 may be glued together at the corners.

Next, the inner reinforcing member 14 is constructed by folding the blank 65 along fold lines 89 until the front and rear panels 86, 88 are angled downward with respect to the top panel 84 at the same angle as the front and rear panels 70, 72 in the outer shell 62. The inner reinforcing member is then placed against the underside of the outer shell 12 and glued thereto to provide a structure having a double thickness of corrugated board at the top, front and rear surfaces. The outer shell 12 and the inner reinforcing member 14 should nest together with their respective top, front and rear panels adjacent to (in contact with) each other and with their openings 79, 90 in substantial alignment.

Figure 8:
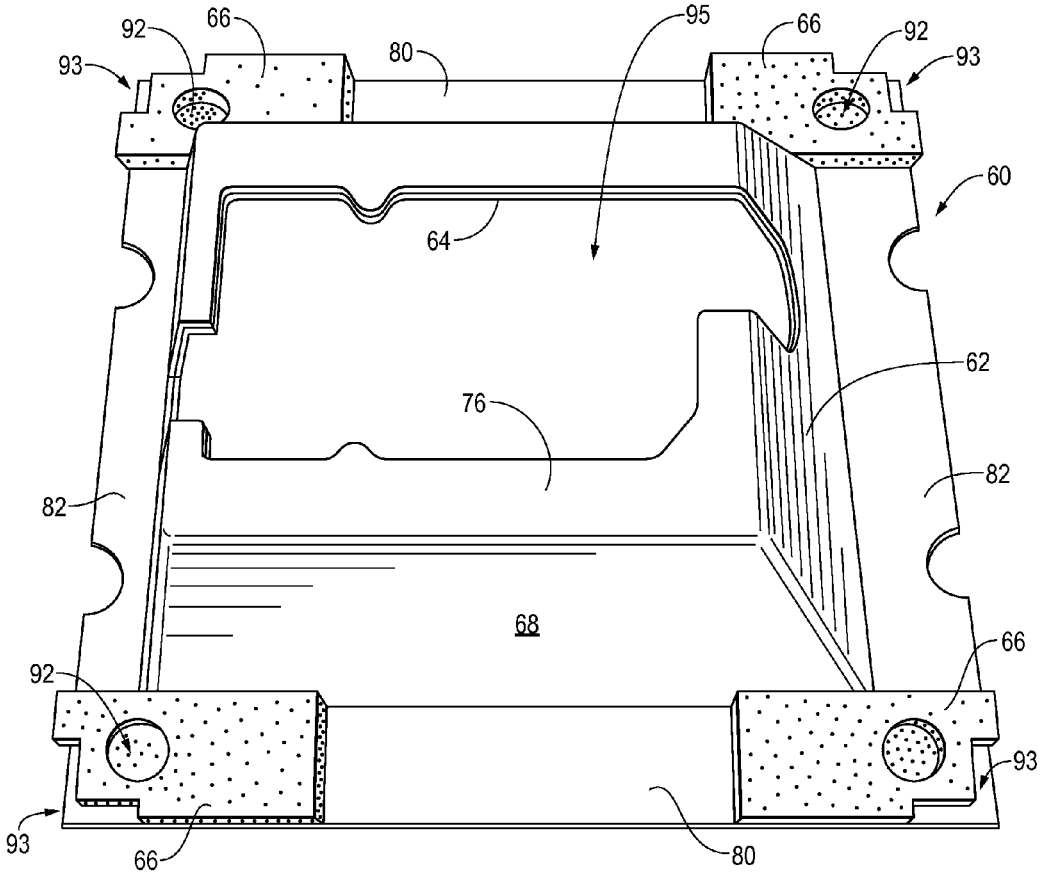
FIG. 8 is a perspective view of a second embodiment of a truncated pyramid shaped shipping base according to the present invention, the base comprising an inner shell and an outer shell.
Figure 9:
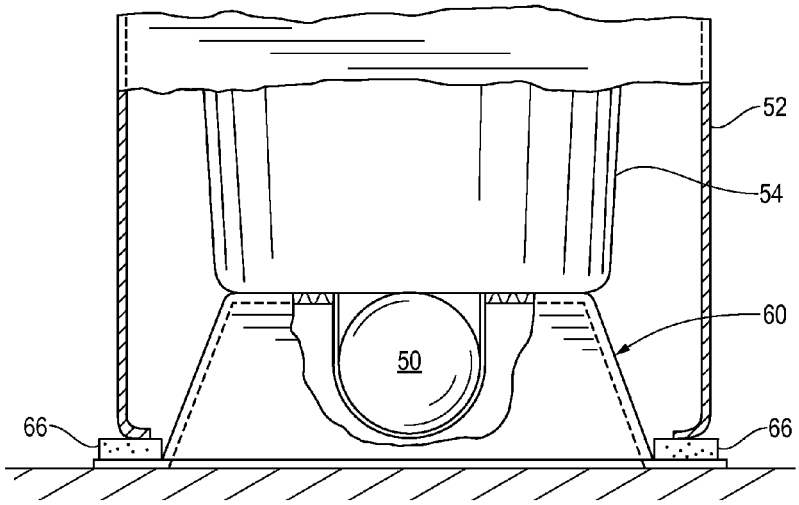
FIG. 9 is a view of the shipping base of FIG. 8 shown installed under a washing machine, the shipping base and washing machine cabinet shown in cutaway view.

Finally, the load bearing cushioning blocks 66 are glued or otherwise adhered to the corners of the shipping base 60. The assembled base is shown in FIG. 8 and a drawing of the assembled base 60 in use is shown in FIG. 9. The assembled base 60 has an opening 95 in the top panel 76 to capture the washing machine motor 50 and associated mechanical components that may be surrounding the motor 50.

Like the foam shipping base 10, the composite shipping base may be nested one on top of another. When the composite shipping bases 60 are nested, the foam cushioning blocks 66 of one base 60 rest on top of the foam cushioning blocks 66 of another base 60.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim:

1. A shipping base for use with an appliance having an undercarriage, the shipping base shaped substantially like a truncated pyramid, the shipping base comprising:

opposing, slanted side panels extending upward from a bottom edge to a top edge and having first upwardly converging vertical edges;

opposing, slanted end panels extending upward from a bottom edge to a top edge and having second upwardly converging vertical edges;

the side panels and end panels being joined together to form the major lateral faces of a square truncated pyramid having four corner panels;

each corner panel being beveled and sharing a first upwardly converging vertical edge with one of the side panels and sharing a second upwardly converging vertical edge with one of the end panels;

a flange extending horizontally outward from the bottom edge of each side panel and the bottom edge of each end panel to form a rectangular, frame-like pallet having four corners, the frame-like pallet defining feet openings at each corner configured to receive appliance feet, the frame-like pallet also defining L-shaped spaces at each corner to accommodate vertical corner posts; and a top panel extending horizontally inward from the top edges of the side panels and end panels, the top panel at least partly defining a top opening configured to receive the undercarriage;

the side panels, end panels, corner panels and top panel defining an interior space within the base within which the undercarriage can be suspended;

wherein the shipping base is made from a single piece of expanded foam material, and wherein the top opening extends into one of the end panels.

2. The shipping base of claim 1 wherein multiple shipping bases can be stacked vertically, with the bases fitting in close proximity to each other.

* * * * *